US008822800B1

(12) United States Patent
Richmond

(10) Patent No.: US 8,822,800 B1
(45) Date of Patent: Sep. 2, 2014

(54) FINGER OPERABLE PERCUSSIVE DEVICE

(71) Applicant: Grant Aaron Richmond, Austin, TX (US)

(72) Inventor: Grant Aaron Richmond, Austin, TX (US)

( * ) Notice: Subject to any disclaimer, the term of this patent is extended or adjusted under 35 U.S.C. 154(b) by 23 days.

(21) Appl. No.: 13/623,221

(22) Filed: Sep. 20, 2012

Related U.S. Application Data

(60) Provisional application No. 61/537,033, filed on Sep. 20, 2011.

(51) Int. Cl.
*G10D 13/02* (2006.01)
*G10D 13/00* (2006.01)

(52) U.S. Cl.
CPC ..... *G10D 13/003* (2013.01)
USPC ..... 84/422.4; 84/402

(58) Field of Classification Search
CPC ..... G10D 13/003
USPC ..... 84/422.4, 402
See application file for complete search history.

(56) References Cited

U.S. PATENT DOCUMENTS

| | | | | | |
|---|---|---|---|---|---|
| 1,885,843 | A | * | 11/1932 | Langer | 84/322 |
| D152,486 | S | * | 1/1949 | Lorillard | D11/38 |
| 2,780,954 | A | * | 2/1957 | Bryce | 84/375 |
| 3,027,794 | A | * | 4/1962 | Chute | 84/406 |
| 3,365,108 | A | * | 1/1968 | Giba | 224/217 |
| 3,730,570 | A | * | 5/1973 | Brochstein | 403/361 |
| 4,681,012 | A | * | 7/1987 | Stelma et al. | 84/422.4 |
| 4,742,696 | A | * | 5/1988 | Jenkins | 63/15 |
| 5,260,506 | A | * | 11/1993 | Cappella | 84/422.4 |
| 5,341,716 | A | * | 8/1994 | Donohoe | 84/422.4 |
| 5,361,671 | A | * | 11/1994 | Genna | 84/422.4 |
| 5,400,685 | A | * | 3/1995 | Cappella | 84/422.4 |
| 5,515,762 | A | * | 5/1996 | Perkins et al. | 84/315 |
| 5,622,062 | A | * | 4/1997 | Gong-Hwa | 63/15 |
| 5,653,524 | A | * | 8/1997 | Gray | 362/104 |
| D388,010 | S | * | 12/1997 | Scheufele | D11/26 |
| 5,761,743 | A | * | 6/1998 | Andrews et al. | 2/21 |
| D434,996 | S | * | 12/2000 | Harkness | D11/26 |
| D451,422 | S | * | 12/2001 | Wenrich | D11/26 |
| 6,734,349 | B1 | * | 5/2004 | Adams | 84/322 |
| 6,838,604 | B2 | * | 1/2005 | Abe et al. | 84/402 |
| 6,881,885 | B2 | * | 4/2005 | Yoshino et al. | 84/402 |
| 7,368,649 | B2 | * | 5/2008 | Mintz | 84/402 |
| 7,514,618 | B2 | * | 4/2009 | Calato | 84/422.4 |
| D625,216 | S | * | 10/2010 | Morgan | D11/26 |
| D649,327 | S | * | 11/2011 | Pavone | D2/617 |
| D654,948 | S | * | 2/2012 | Richmond | D17/22 |
| 8,232,466 | B2 | * | 7/2012 | Slick et al. | 84/402 |
| 8,242,342 | B2 | * | 8/2012 | Bettinelli | 84/402 |
| 8,362,350 | B2 | * | 1/2013 | Kockovic | 84/743 |
| 2011/0132181 | A1 | * | 6/2011 | Kockovic | 84/723 |

FOREIGN PATENT DOCUMENTS

DE 20006924 U1 * 8/2000

* cited by examiner

*Primary Examiner* — Robert W Horn
(74) *Attorney, Agent, or Firm* — Buskop Law Group, PC; Wendy Buskop

(57) ABSTRACT

A finger operable percussive device for initiating acoustic signals, which can include a percussive member configured to initiate the acoustic signals upon impact with objects. The percussive member can have a curved top surface configured to allow the percussive member to initiate the acoustic signals upon impact with the objects at any angle. The percussive member can be connected with a top of a base. The base can be configured to contour to the user's finger and allow articulation of the user's finger. A securing member can be connected with the base for securing the base onto a user's finger. The securing member can be made of a flexible material configured to allow articulation of the user's finger.

18 Claims, 13 Drawing Sheets

FINGER OPERABLE PERCUSSIVE DEVICE

CROSS REFERENCE TO RELATED APPLICATION

The present application claims priority to and the benefit of U.S. Provisional Patent Application Ser. No. 61/537,033 filed on Sep. 20, 2011, entitled "FINGER OPERABLE PERCUSSIVE DEVICE." This reference is hereby incorporated in its entirety.

FIELD

The present embodiments generally relate to a percussive device for initiating an acoustic signal, such as on a percussion instrument or other object.

BACKGROUND

A need exists for a finger operable percussive device for initiating an acoustic signal with a specific timbre.

A need exists for a finger operable percussive device that can be fastened onto fingers that may not have to be gripped by a user's hand.

A further need exists for a finger operable percussive device that can be conveniently and easily worn at any location, allowing the user to initiate acoustic signals at any location by striking a variety of objects.

A further need exists for a finger operable percussive device that can be adapted to have multiple removable and replaceable percussive members made of a variety of materials, such that the user can configure the finger operable percussive device to produce acoustic signals with a variety of specific timbres.

The present embodiments meet these needs.

BRIEF DESCRIPTION OF THE DRAWINGS

The detailed description will be better understood in conjunction with the accompanying drawings as follows.

Figure 1:
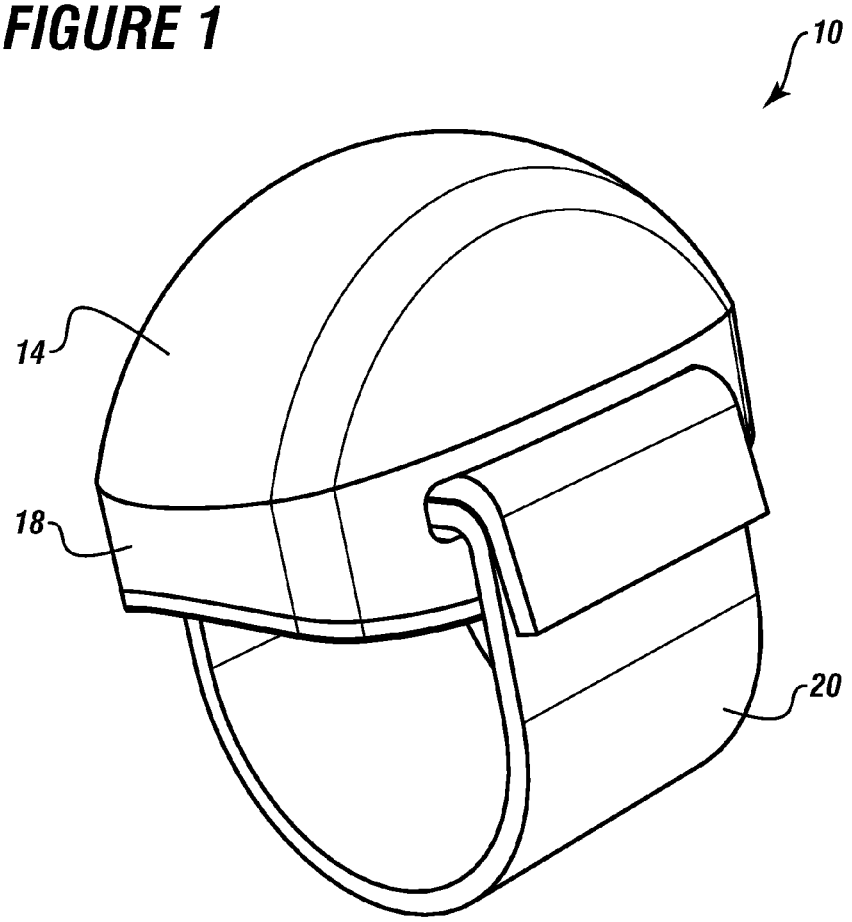
FIG. 1 depicts an isometric view of the finger operable percussive device according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a finger operable percussive device for initiating acoustic signals. In one or more embodiments, the finger operable percussive device can weigh less than five ounces.

The finger operable percussive device can include a percussive member configured to initiate the acoustic signals upon impact with an object. The object can be a percussion instrument or any other object.

In one or more embodiments, the percussive member can be made of: a spring, felt, cloth, fabric, wood, hardwood, oak, cork, rubberized cork, rubber, foam rubber, polymer, hard plastic, nylon, resin, brass, polished aluminum, bendable metal, another metal, a material configured to form a specific timbre for the percussive member upon impact with the object, or combinations thereof.

The percussive member can be made of one or more materials configured to form a specific timbre for the percussive member upon impact with the object. For example, the percussive member can have a material composition, density, thickness, shape, and surface characteristic configured to form the specific timbre.

In one or more embodiments, the percussive member can be made of a first material and second material. The second material can be overlaid or otherwise disposed over the first material to form a specific timbre for the percussive member.

The percussive member can be rounded, rectangular, disc shaped, crescent shaped, egg shaped, oval shape, square, or another shape.

The percussive member can have a curved top surface, which can allow the percussive member to initiate the acoustic signal upon impact with the object at any angle. The curved top surface can have a semi-circular profile.

The finger operable percussive device can include a base. The percussive member can be connected with a top of the base. In one or more embodiments, the base can be made of wood, polymer, plastic, aluminum, another metal, another material, or combinations thereof.

A bottom of the base can be configured to engage with the user to provide a contoured and comfortable fit between the user's finger and the base.

In one or more embodiments, the base can have an upper portion and a lower portion, which can form a ledge. The percussive member can have a percussive member cavity. The upper portion of the base can be configured to engage within the percussive member cavity to connect the percussive member with the base.

The percussive member can be detachable from the base, allowing for replacement of the percussive member with a replacement percussive member.

The finger operable percussive device can include a member connected with the base for securing the base onto a user.

The securing member can be: a band, a strap, an adjustable band, an adjustable strap, an elastic band, an elastic strap, a molded plastic ring, a magnet, a button, a snap, a hook and loop fastener, or combinations thereof.

In one or more embodiments, the securing member can be made of nylon, leather, fake leather, hemp, polyester, plastic, mesh fabric, another fabric, or combinations thereof.

In operation, the securing member can be configured to be worn on the user's finger, knuckle, wrist, a portion of the user's hand, or other portion of the user's body.

In one or more embodiments, the finger operable percussive device can be a single molded piece. In another embodiment, the finger operable percussive device can be molded with multiple pieces.

The securing member and base can be configured to allow articulation of the user's finger.

The finger operable percussive device can include a pad connected with a bottom of the base. The pad can be configured to engage with the user to provide a contour fit between a finger of the user and the base. The pad can be a foam pad, rubber pad, foam rubber pad, polyurethane foam pad, or neoprene foam pad. The pad can be a contoured pad.

In one or more embodiments, the pad can be configured to provide impact-resistance to the user's finger upon impact of the percussive member with the object.

In one or more embodiments, the base can include a cavity, a dowel slot formed in a portion of the base within the cavity, a first insert slot disposed through a first side of the base, and a second insert slot disposed through a second side of the base opposite the first insert slot. The securing member can be a band or strap engaged through the first insert slot and second insert slot. A dowel pin can be engaged into the dowel slot, and a portion of the securing member can be engaged about the dowel pin to secure the securing member with the base.

In one or more embodiments, the base can have a first convex curved edge along the first side of the base, a second convex curved edge along the second side of the base, a first concave curved edge along the front side of the base, and a second concave curved edge along the back side of the base. In operation, the first convex curved edge, second convex curved edge, first concave curved edge, and second concave curved edge can be configured to engage with the user's finger to provide a contour fit between the user's finger and the base.

In one or more embodiments, a fastener can be disposed through a portion of the base and percussive member to secure the percussive member to the base.

A screw thread insert, an ultrasonic fastener, or a press fit fastener can be disposed between the fastener and percussive member. The screw thread insert can be at least partially bonded to a portion of the percussive member to provide a secure connection. The ultrasonic fastener can be at least partially bonded to a portion of the percussive member to provide a secure connection.

The base can be operatively connected with the percussive member during a molding process, and the securing member can be operatively connected with the base during the molding process, wherein the base can be a unitary piece with the percussive member and the securing member.

The base, percussive member, and securing member can be formed as independent pieces, and the base can be operatively connected to the percussive member using a mechanical or adhesive fastener; and the securing member can be operatively connected with the base using a mechanical or adhesive fastener.

The percussive member, the base, and the securing member can be operatively connected to one another as a two piece assembly, a three piece assembly, or during a molding process as a unitary body.

Turning now to the Figures, FIG. 1 depicts an isometric view of the finger operable percussive device 10.

The finger operable percussive device 10 can include a percussive member 14 configured to initiate an acoustic signal upon impact with an object.

The percussive member 14 can be connected with a top of a base 18. The base 18 can be contoured to fit a finger of a user.

The finger operable percussive device 10 can include a securing member 20 connected with the base 18 for securing the base 18 onto the user. As such, the user can wear the finger operable percussive device 10 and use the finger operable percussive device 10 to initiate acoustic signals.

Figure 2:
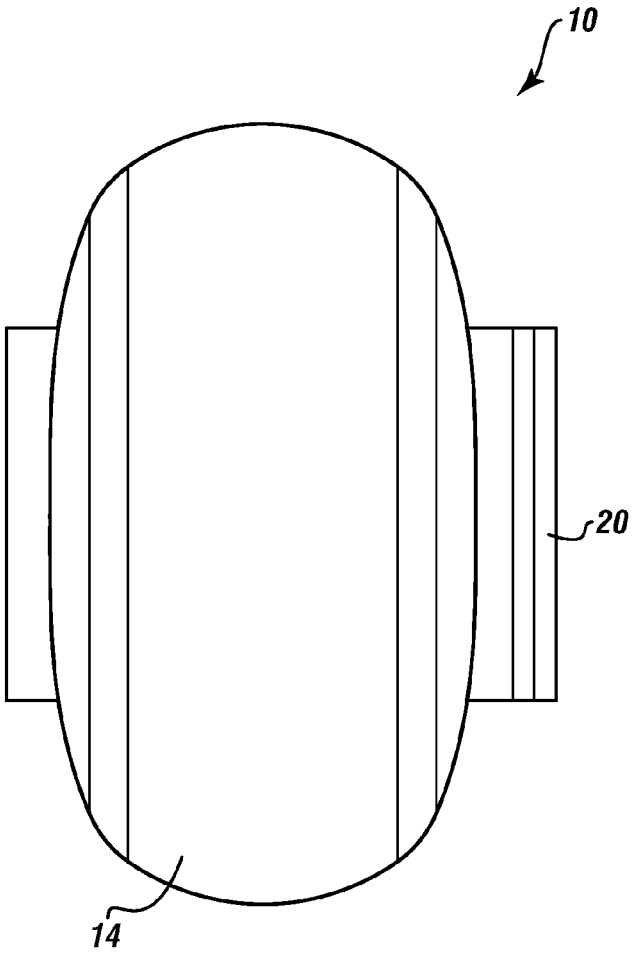
FIG. 2 depicts a top view of the finger operable percussive device according to one or more embodiments.

FIG. 2 depicts a top view of the finger operable percussive device 10 with the percussive member 14 and the securing member 20.

The percussive member 14 can be made of a spring, felt, cloth, fabric, wood, hardwood, oak, cork, rubberized cork, rubber, foam rubber, polymer, hard plastic, nylon, resin, brass, polished aluminum, bendable metal, another metal, or combinations thereof.

In one or more embodiments, the percussive member 14 can be made of a material configured to form a specific timbre for the percussive member 14 upon impact with the object. For example, the material composition, density, thickness, shape, and surface characteristics can be selected and/or configured to initiate acoustic signals with a specific timbre upon impact with objects. The density of the percussive member 14 can be sufficient to produce a distinguishable sound upon impact with objects.

The percussive member 14 can be rounded, rectangular, disc shaped, crescent shaped, egg shaped, oval shape, square, or another shape.

Figure 3:
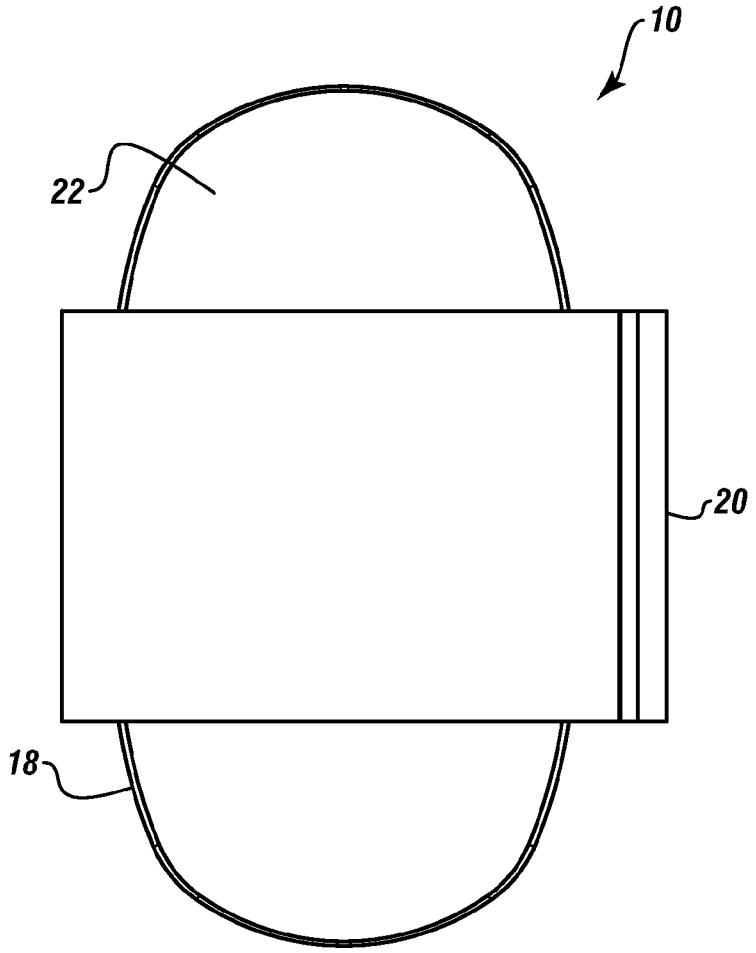
FIG. 3 depicts a bottom view of the finger operable percussive device according to one or more embodiments.

FIG. 3 depicts a bottom view of the finger operable percussive device 10 with the securing member 20 connected with a portion of the base 18.

The securing member 20 can be a band, strap, adjustable band, adjustable strap, elastic band, elastic strap, a molded plastic ring, magnet, button, snap, hook and loop fastener, any member configured to engage the finger operable percussive device 10 with a portion of a user, or combinations thereof.

The securing member 20 can be configured to be worn on a user's finger, knuckle, wrist, a portion of the user's hand, or another portion of the user's body.

The securing member 20 and base 18 can be configured to allow articulation of the user's finger. For example, the base 18 can have a contoured fit with the user's finger and the securing member can be made of a flexible material.

In one or more embodiments, the securing member 20 can be made of nylon, leather, fake leather, hemp, polyester, plastic, mesh fabric, another fabric, another material, or combinations thereof.

In one or more embodiments, a pad 22 can be engaged with a bottom of the base 18. The pad 22 can be configured to be engaged between the base 18 and the user's finger to provide comfort, shock absorption, and a contoured fit with the user's finger.

Figure 4A:
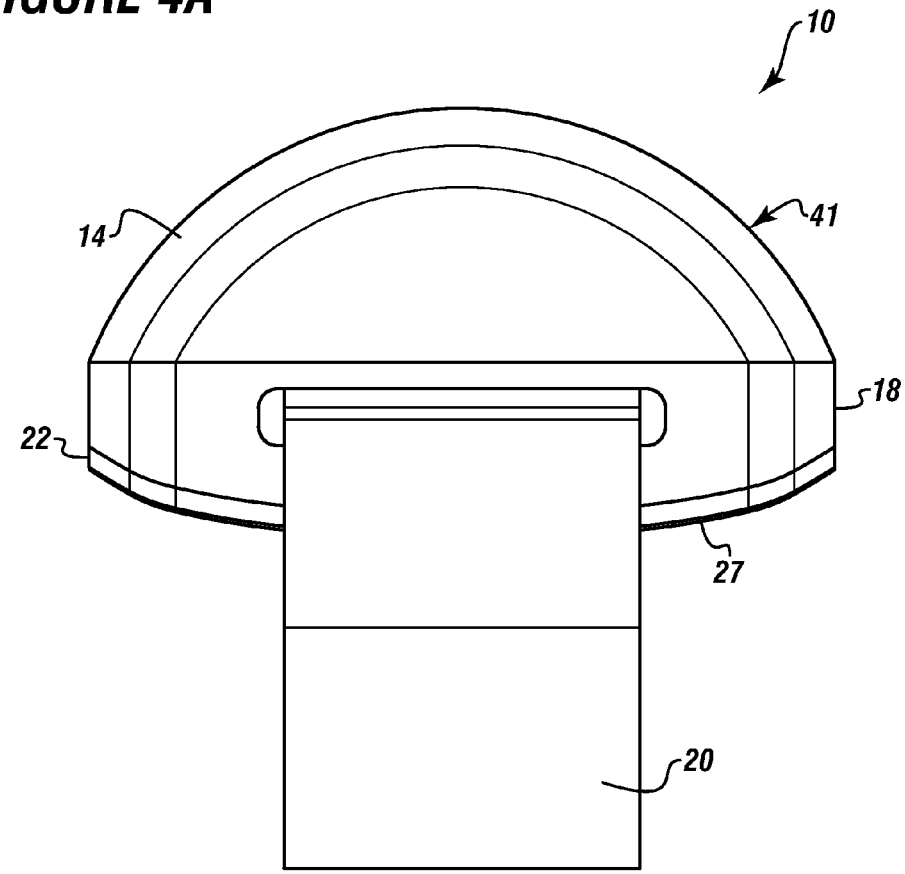
FIG. 4A depicts a first side view of the finger operable percussive device according to one or more embodiments.
Figure 4B:
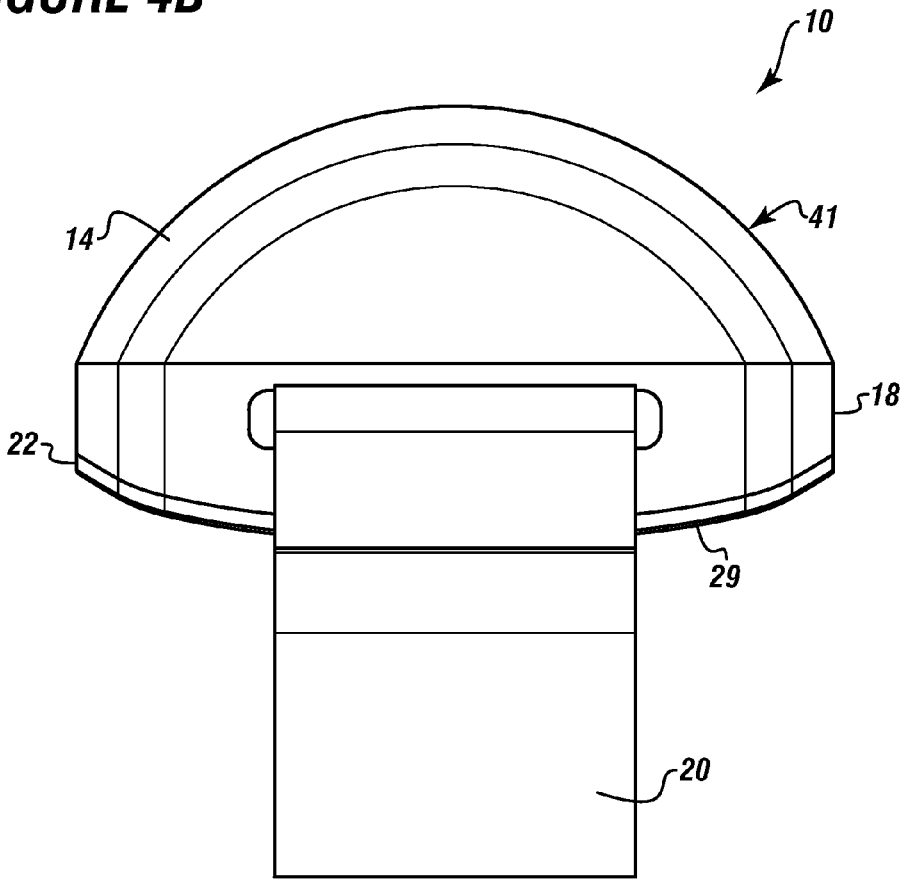
FIG. 4B depicts a second side view of the finger operable percussive device according to one or more embodiments.
Figure 4C:
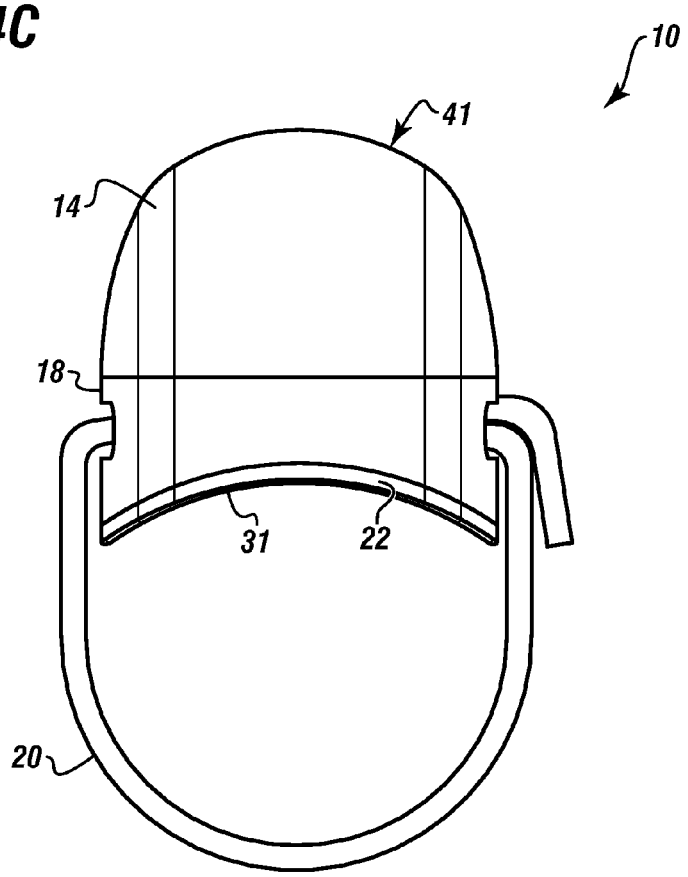
FIG. 4C depicts a front view of the finger operable percussive device according to one or more embodiments.
Figure 4D:
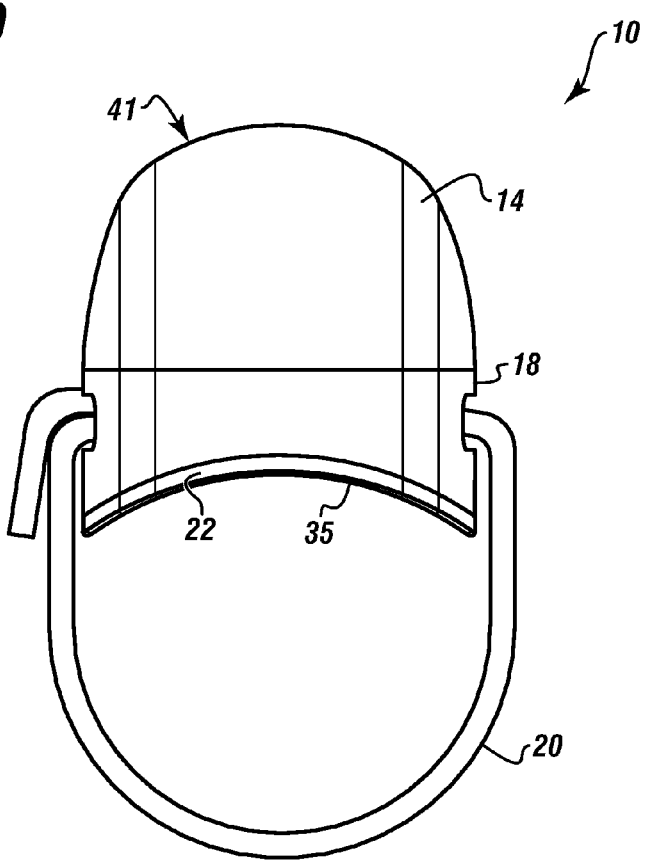
FIG. 4D depicts a back view of the finger operable percussive device according to one or more embodiments.

FIG. 4A depicts a first side view of the finger operable percussive device 10, FIG. 4B depicts a second side view of the finger operable percussive device 10, FIG. 4C depicts a front view of the finger operable percussive device 10, and FIG. 4D depicts a back view of the finger operable percussive device 10.

The finger operable percussive device 10 can have the percussive member 14 engaged with the base 18, the securing member 20 engaged with the base 18, and the pad 22 engaged with the base 18.

The percussive member 14 can have a curved top surface 41. The curved top surface 41 can allow the percussive member 14 to initiate acoustic signals upon impact with objects at any angle. The curved top surface 41 can have a semi-circular profile.

The base 18 can have a first convex curved edge 27 along the first side of the base 18, second convex curved edge 29 along the second side of the base 18, first concave curved edge 31 along a front side of the base 18, and second concave curved edge 35 along a back side of the base 18.

The first convex curved edge 27, second convex curved edge 29, first concave curved edge 31, and second concave curved edge 35 can be configured to engage with the user to provide a contour fit between the user's finger and the base 18.

For example, the first concave curved edge 31 and second concave curved edge 35 can engage with a top surface of the user's finger and can contour thereto, such that the user's finger is engaged within the concave portions of the first concave curved edge 31 and second concave curved edge 35. The first convex curved edge 27 and second convex curved edge 29 can engage about sides of the user's finger, and can contour thereto. As such, the base 18 and pad 22 can provide a contoured and secure fit with the user's finger, allowing the user to strike objects to produce acoustic signals in a controlled manner.

Figure 5:
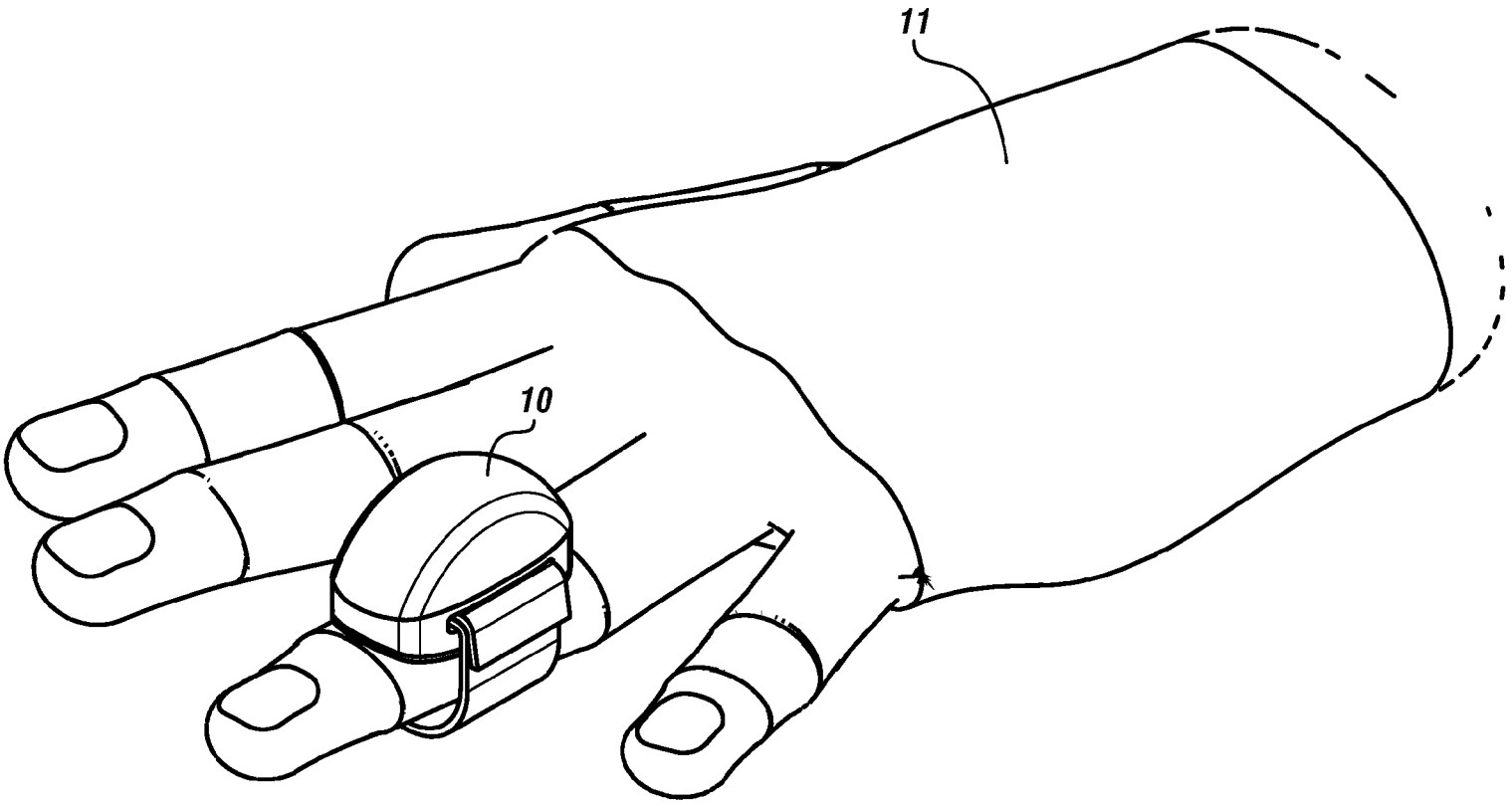
FIG. 5 depicts the finger operable percussive device engaged on a finger of a user according to one or more embodiments.

FIG. 5 depicts the finger operable percussive device 10 engaged on a finger of a user 11 according to one or more embodiments.

In operation, the user 11 can strike objects with the finger operable percussive device 10 while wearing the finger operable percussive device 10 to produce acoustic signals.

The object can be any object capable of producing an acoustic signal upon impact with the finger operable percussive device 10. For example, the object can be a percussion instrument, such as cymbals, wood blocks, bells, a xylophone, a marimba, drums, or the like. In one or more embodiments, the finger operable percussive device 10 can be adapted for use with electronic instruments, such as electronic kits or electronic drums.

Figure 6A:
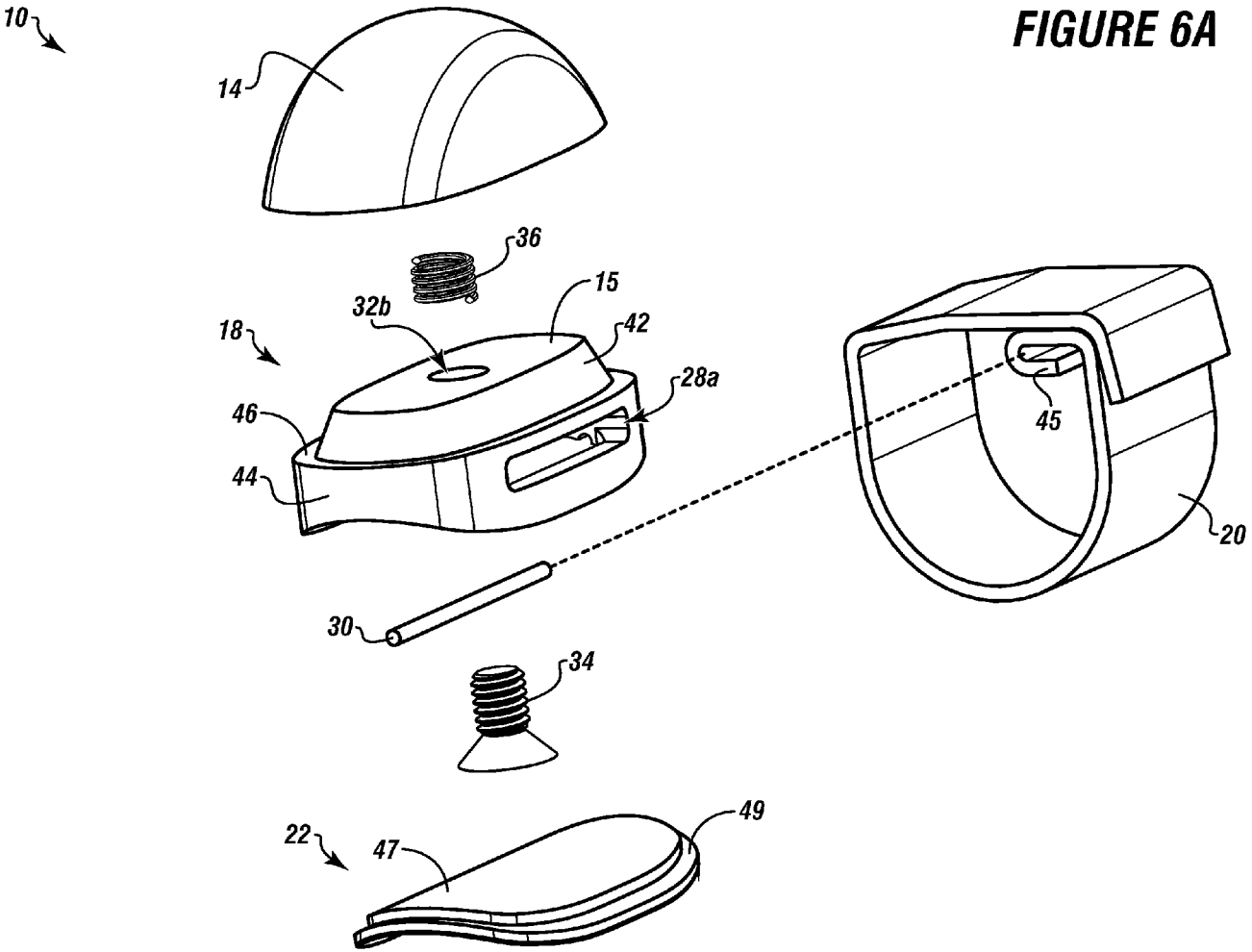
FIGS. 6A-6C depict exploded views of the finger operable percussive member according to one or more embodiments.
Figure 6B:
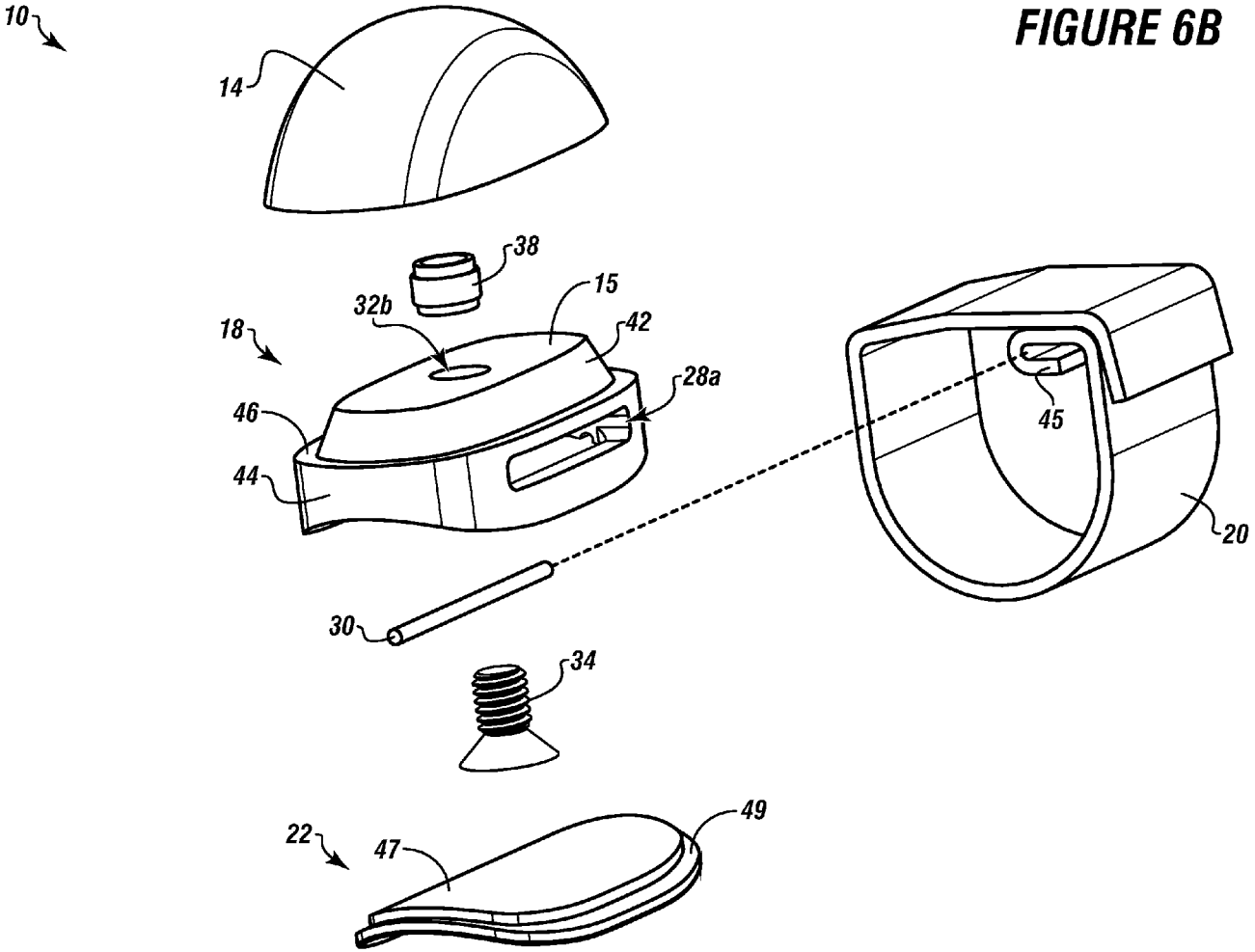
Figure 6C:
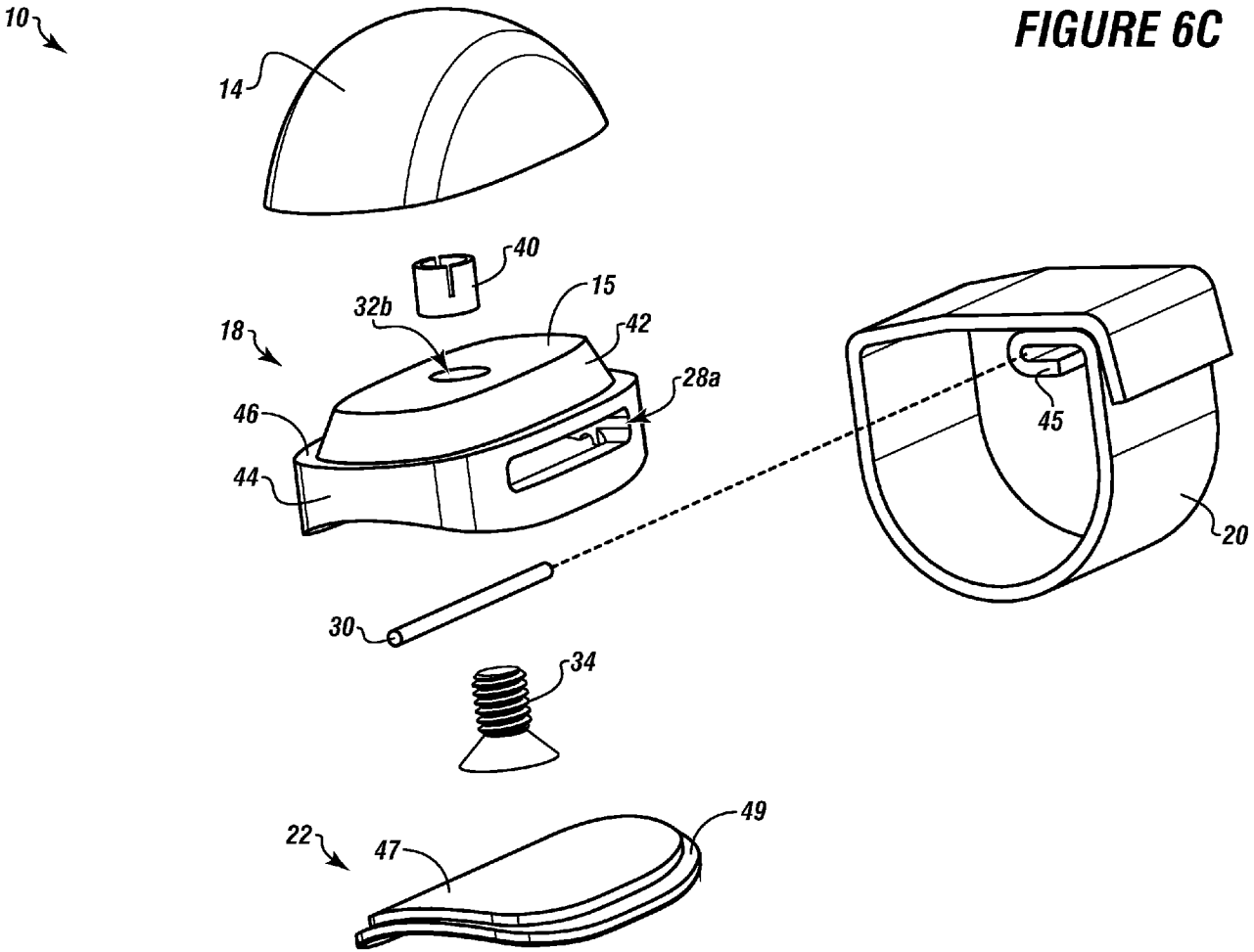

FIGS. 6A-6C depict exploded views of the finger operable percussive device 10.

The base 18 can have an upper portion 42 and lower portion 44, forming a ledge 46.

The upper portion 42, including a top 15 of the base 18, can be configured to engage within a percussive member cavity of the percussive member 14 to connect the percussive member 14 with the base 18.

The base 18 can have a second fastener hole 32*b* disposed through a top 15 of the base 18.

In one or more embodiments, a fastener 34 can be disposed through the second fastener hole 32*b*, through a screw thread insert 36, and into a first fastener hole in the percussive member cavity of the percussive member 14, as shown in FIG. 6A. As such, the percussive member 14 can be secured to the base 18.

The screw thread insert 36 can be disposed between the fastener 34 and the percussive member 14. The screw thread insert 36 can be at least partially bonded to a portion of the percussive member 14. For example, during assembly of the finger operable percussive device 10, the screw thread insert 36 can be heated before being engaged with the fastener 34 and within the first fastener hole in the percussive member cavity of the percussive member 14. The heated screw thread insert 36 can be allowed to cool and at least partially bond to the percussive member 14 within the first fastener hole. An example of a screw thread insert can be one available from Heli-Coil of Shelton, Conn.

In one or more embodiments, the fastener 34 can be disposed through the second fastener hole 32*b*, through an ultrasonic fastener 38, and into the first fastener hole in the percussive member cavity of the percussive member 14, as shown in FIG. 6B. The ultrasonic fastener 38 can be at least partially bonded to a portion of the percussive member 14, which can be accomplished in substantially the same way as with the screw thread insert 36 as described in FIG. 6A.

In one or more embodiments, the fastener 34 can be disposed through the second fastener hole 32*b*, through a press fit fastener 40, and into the first fastener hole in the percussive member cavity of the percussive member 14, as shown in FIG. 6C. The press fit fastener 40 can be press fit within the first fastener hole in the percussive member cavity of the percussive member 14.

The pad 22 can be connected with a bottom of the base 18. For example, the pad 22 can have a pad upper portion 47 and pad lower portion 49. The pad upper portion 47 can engage within a cavity of the base 18, and the pad lower portion 49 can engage with a bottom of the base 18.

The pad 22 can be configured to engage with the user to provide a contoured fit between the user's finger and the base.

The pad 22 can be configured to provide shock absorption and impact-resistance to the user's finger upon impact of the percussive member 14 with objects.

The pad 22 can be a foam pad, rubber pad, foam rubber pad, polyurethane foam pad, neoprene foam pad, or combinations thereof.

The securing member 20 can be engaged through insert slots in the base 18, such as through a first insert slot 28*a* and second insert slot, not shown in this Figure, opposite the first insert slot 28*a*.

A dowel pin 30, which can be made of steel or another material, can be engaged into a dowel slot of the base 18, and a portion of the securing member 20 can be engaged about the dowel pin 30 to secure the securing member 20 with the base 18. For example, a securing member end 45 can be hooked or folded about the dowel pin 30 within the base 18.

Figure 7C:
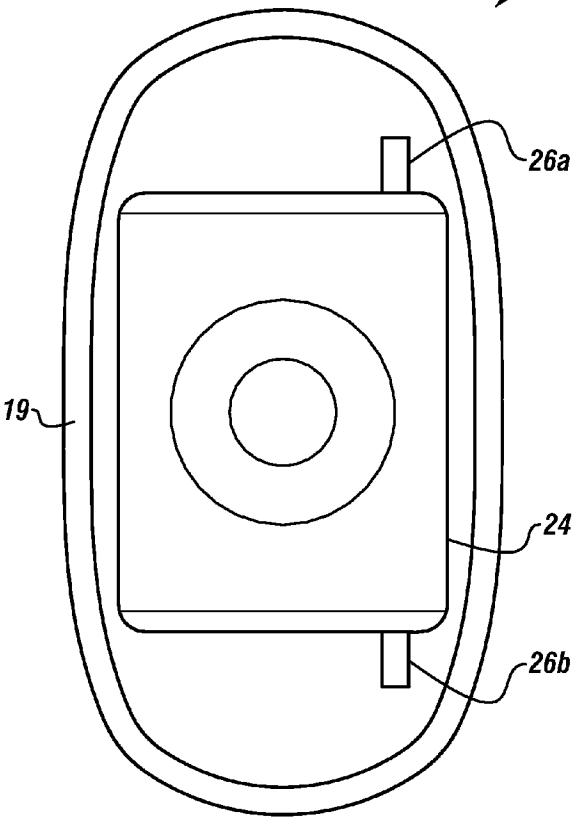
FIGS. 7A-7C depict detailed views of the base with a top and a bottom according to one or more embodiments.
Figure 7A:
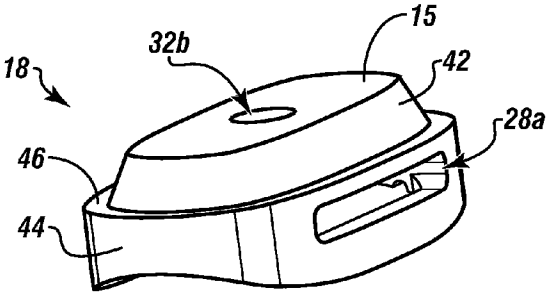
Figure 7B:
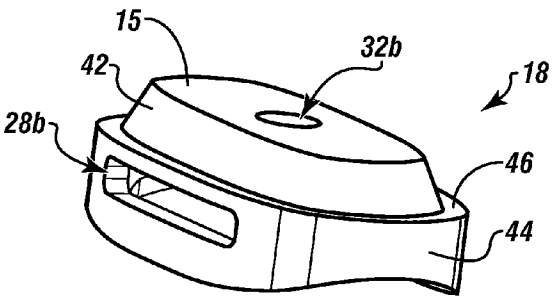

FIGS. 7A-7C depict detailed views of the base 18 having a top 15, bottom 19, second fastener hole 32*b*, upper portion 42, lower portion 44, and ledge 46.

The base 18 can include a cavity 24, which can be formed into the bottom 19 of the base 18.

Dowel slots 26*a* and 26*b* can be formed or disposed into a portion of the bottom 19 of the base 18. The dowel slots 26*a* and 26*b* can be configured to receive the dowel pin, allowing the dowel pin to retain the securing member.

The base 18 can have the first insert slot 28*a* disposed through a first side of the base 18, and second insert slot 28*b* disposed through a second side of the base 18 opposite the first insert slot 28*a*. The securing member can be a band or strap engaged through the first insert slot 28*a* and second insert slot 28*b* and with the dowel pin in the dowel slots 26*a* and 26*b*.

In one or more embodiments, the base 18 can be made of wood, polymer, plastic, aluminum, another metal, another material, or combinations thereof.

The bottom 19 of the base 18 can be configured to engage with the user's finger to provide a contour fit between the user's finger and the base 18.

Figure 8:
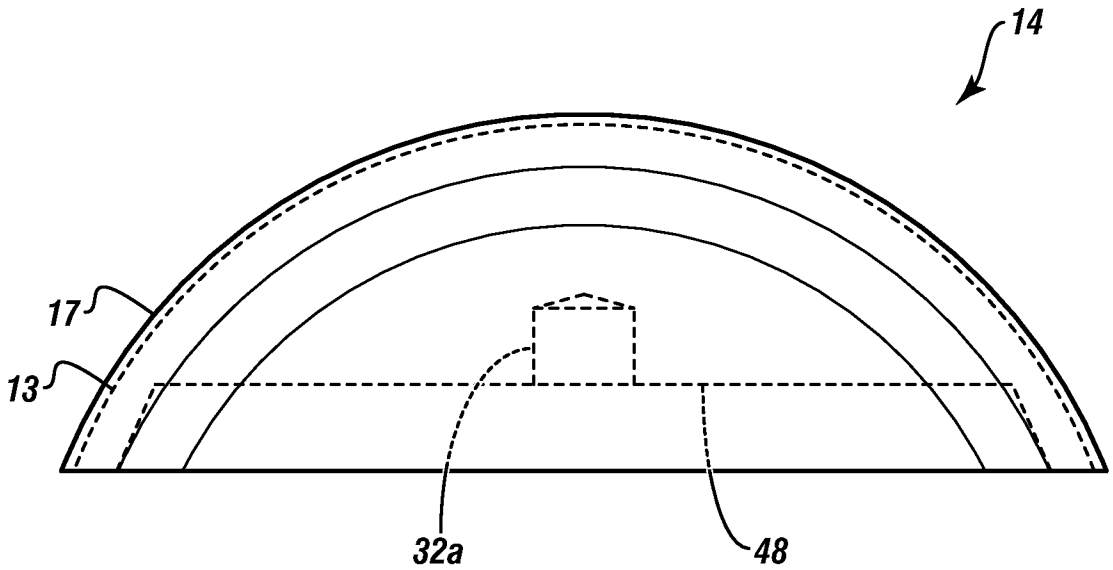
FIG. 8 depicts a side view of the percussive member according to one or more embodiments.

FIG. 8 depicts a side view of the percussive member 14 according to one or more embodiments.

The percussive member 14 can have the percussive member cavity 48 formed therein.

The first fastener hole can be formed into a surface of the percussive member 14 in the percussive member cavity 48.

The percussive member 14 can be made of one or more materials configured to form a specific timbre for the percussive member 14 upon impact with an object.

In one or more embodiments, the percussive member 14 can be made of a first material 13 and a second material 17.

The second material 17 can be overlaid or otherwise disposed over the first material 13 to form a specific timbre for the percussive member 14.

In one or more embodiments, the percussive member 14 can be detachable from the finger operable percussive device. For example, the percussive member 14 can be detachable from the base to allow for replacement with another percussive member. As such, the user can change the particular percussive member to change the specific timbre produced by the finger operable percussive device.

While these embodiments have been described with emphasis on the embodiments, it should be understood that within the scope of the appended claims, the embodiments might be practiced other than as specifically described herein.

What is claimed is:

1. A finger operable percussive device for initiating acoustic signals, wherein the finger operable percussive device comprises:

a. a percussive member configured to initiate an acoustic signal upon impact with an object;

b. a base operatively connected with the percussive member, wherein the base comprises: a cavity, a dowel slot, a first insert slot disposed through a first side of the base; and a second insert slot disposed through a second side of the base opposite the first insert slot;

c. a securing member operatively connected with the base, wherein the securing member is a band or strap engaged through the first insert slot and the second insert slot; and d. a dowel pin is engaged into the dowel slot, wherein a portion of the securing member is engaged about the dowel pin to secure the securing member with the base.

2. The finger operable percussive device of claim 1, further comprising a pad connected with a bottom of the base.

3. The finger operable percussive device of claim 2, wherein the pad is a foam pad, a rubber pad, a foam rubber pad, a polyurethane foam pad, or a neoprene foam pad.

4. The finger operable percussive device of claim 2, wherein the pad is configured to provide impact-resistance to the user's finger upon impact of the percussive member with the object.

5. The finger operable percussive device of claim 1, wherein the securing member comprises: a band, a strap, an adjustable band, an adjustable strap, an elastic band, an elastic strap, a molded plastic ring, a magnet, a button, a snap, a hook and loop fastener, or combinations thereof.

6. The finger operable percussive device of claim 1, wherein the securing member is made of nylon, leather, fake leather, hemp, polyester, plastic, mesh fabric, another fabric, or combinations thereof.

7. The finger operable percussive device of claim 1, wherein:

a. the base further comprises an upper portion and a lower portion forming a ledge; and b. the percussive member further comprises a percussive member cavity, wherein the upper portion is configured to engage within the percussive member cavity to connect the percussive member with the base.

8. The finger operable percussive device of claim 1, wherein the percussive member is rounded, rectangular, disc shaped, crescent shaped, egg shaped, oval shape, or square.

9. The finger operable percussive device of claim 1, wherein the percussive member has a curved top surface allowing the percussive member to initiate the acoustic signal upon impact with the object at any angle.

10. The finger operable percussive device of claim 9, wherein the curved top surface has a semi-circular profile.

11. The finger operable percussive device of claim 1, wherein the percussive member is detachable from the base allowing for replacement of the percussive member with a replacement percussive member.

12. The finger operable percussive device of claim 1, wherein the percussive member comprises a material configured to create a sound upon impact with the object.

13. The finger operable percussive device of claim 1, wherein the percussive member comprises:

a. a first material; and b. a second material, wherein the second material is overlaid on the first material forming a specific timbre for the percussive member.

14. The finger operable percussive device of claim 1, wherein:

a. the base is configured to contour to the finger of the user and allow articulation of the finger;

b. the securing member is made of a flexible material configured to allow articulation of the user's finger; and c. the percussive member has a curved top surface configured to allow the percussive member to initiate the acoustic signal upon impact with the object at any angle.

15. The finger operable percussive device of claim 1, wherein the base comprises:

a. a first convex curved edge along a first side of the base;

b. a second convex curved edge along a second side of the base;

c. a first concave curved edge along a front side of the base; and d. a second concave curved edge along a back side of the base, wherein the first convex curved edge, the second convex curved edge, the first concave curved edge, and the second concave curved edge are configured to provide a contoured fit.

16. A finger operable percussive device for initiating acoustic signals, wherein the finger operable percussive device comprises:

a. a percussive member configured to initiate an acoustic signal upon impact with an object, wherein the percussive member comprises a curved top surface;

b. a base operatively connected with the percussive member, wherein the base comprises:

(i) a first convex curved edge along a first side of the base;

(ii) a second convex curved edge along a second side of the base;

(iii) a first concave curved edge along a front side of the base; and (iv) a second concave curved edge along a back side of the base, wherein the first convex curved edge, the second convex curved edge, the first concave curved edge, and the second concave curved edge are configured to provide a contoured fit; and c. a securing member operatively connected with the base.

17. A finger operable percussive device for initiating acoustic signals, wherein the finger operable percussive device comprises:

a. a percussive member configured to initiate an acoustic signal upon impact with an object, wherein the percussive member comprises a curved top surface;

b. a base operatively connected with the percussive member, wherein the base comprises: a cavity, a dowel slot, a first insert slot disposed through a first side of the base; and a second insert slot disposed through a second side of the base opposite the first insert slot;

c. a securing member operatively connected with the base, wherein the securing member is a band or strap engaged through the first insert slot and the second insert slot; and d. a dowel pin is engaged into the dowel slot, wherein a portion of the securing member is engaged about the dowel pin to secure the securing member with the base.

18. A finger operable percussive device for initiating acoustic signals, wherein the finger operable percussive device comprises:

a. a percussive member configured to create a sound upon impact with an object;

b. a base operatively connected with the percussive member, wherein the base comprises:

(i) a first convex curved edge along a first side of the base;

(ii) a second convex curved edge along a second side of the base;

(iii) a first concave curved edge along a front side of the base; and (iv) a second concave curved edge along a back side of the base, wherein the first convex curved edge, the second convex curved edge, the first concave curved edge, and the second concave curved edge are configured to provide a contoured fit; and c. a securing member operatively connected with the base.

* * * * *